US006310308B1

(12) United States Patent
Watson et al.

(10) Patent No.: US 6,310,308 B1
(45) Date of Patent: Oct. 30, 2001

(54) COMPACT PUSH-BUTTON SWITCH ASSEMBLY

(75) Inventors: Jeffrey Watson, Issaquah; Bryan Sammons, Kirkland, both of WA (US)

(73) Assignee: Spectra Lux Corporation, Kirkland, WA (US)

( * ) Notice: Subject to any disclaimer, the term of this patent is extended or adjusted under 35 U.S.C. 154(b) by 0 days.

(21) Appl. No.: 09/666,403

(22) Filed: Sep. 20, 2000

(51) Int. Cl.[7] ..... H01H 9/18
(52) U.S. Cl. ..... 200/520; 200/314; 200/345
(58) Field of Search ..... 200/16 R–16 D, 200/520, 533, 534, 310, 313, 314, 341, 345

(56) References Cited

U.S. PATENT DOCUMENTS 4,496,813 * 1/1985 Fukushima ..... 200/314
5,032,698 * 7/1991 Satoh ..... 200/341
5,252,798 * 10/1993 Kamada ..... 200/314
5,399,820 * 3/1995 Silfvast ..... 200/314
5,878,870 * 3/1999 Ohtaki ..... 200/314

* cited by examiner

*Primary Examiner*—Michael Friedhofer
(74) *Attorney, Agent, or Firm*—Davis Wright Tremaine LLP

(57) ABSTRACT

A push-button switch assembly adapted for use on a printed circuit board having a contact switch attached thereto. The switch assembly comprises a base attachable to the printed circuit board, the base having an interior cavity sized and shaped to receive the contact switch therein; an actuator disposed within the interior cavity of the base and positioned in contact with the contact switch; and a cap having an interior cavity therein, wherein a portion of the interior cavity of the cap is sized to slidably receive the base therein, and wherein the cap is in contact with the actuator.

16 Claims, 2 Drawing Sheets

COMPACT PUSH-BUTTON SWITCH ASSEMBLY

FIELD OF THE INVENTION

The present invention relates to push-button switches, and in particular to a compact switch assembly which may be illuminated or non-illuminated.

BACKGROUND

Some commonly used switch assemblies have little or no bearing surface to insure even, on-axis/linear motion during actuation. When actuated with an off-center force, the key can tip off-axis and one side or corner will move noticeably much more than the rest of the key. This is known as key "diving" or tipping. Resultant forces on other related switch components may also be off center, friction often occurs as a result of mechanical interference and potential binding exists. Variations in the actuation force required to activate the contact switch are dependent upon the degree of tipping. In cases where the surrounding panel allows enough key movement and the panel design doesn't correct it, the key can actually get lodged under the front panel/housing during key diving.

Existing switches that have support for key movement are typically discrete units encased in an external housing. That housing enhances linear motion through external support. Due to the complexity of the external housing for such keys, manufacturing costs can be high. Additionally, device designs with dense populations of switches are more difficult, because more space may be required for all the external housings and related mounting requirements Keys that have such unsupported motion can also create challenges for controlling light transmission through the switch and light leakage around the edges. One version of known technology has the light source on the circuit board at the same level as the switch. The switch contact can be an obstruction to the light path because the light sources are typically mounted off center from the key, next to the circuit board mounted switch. This causes unique manufacturing challenges as the light sources have to be very accurately aligned in order to direct an adequate amount of light past the switch and into the light transmission area of the key. Additionally this approach requires more area on the circuit board due to the placement of the mentioned components.

Yet other technology has the light within the key but connected to flexible circuitry to allow for key movement in relation to the switchboard. The lighting and switch circuitry in this design are both stationary in relation to key movement, thereby eliminating failures of flexible conductors due to fatigue or vibration.

SUMMARY OF THE INVENTION

The present invention provides a push-button switch assembly adapted for use on a printed circuit board having a contact switch attached thereto. The switch assembly comprises a base attachable to the printed circuit board, the base having an interior cavity sized and shaped to receive the contact switch therein; an actuator disposed within the interior cavity of the base and positioned in contact with the contact switch; and a cap having an interior cavity therein, wherein a portion of the interior cavity of the cap is sized to slidably receive the base therein, and wherein the cap is in contact with the actuator.

DETAILED DESCRIPTION OF THE INVENTION

Described below is an embodiment of the present invention. The embodiment illustrates one way in which the present invention can be implemented. Although the embodiment shown is an illuminated switch, the invention may be used for various other purposes, including a non-illuminated switch. In the descriptions that follow, like numerals represent like elements in all figures. For example, where the numeral 10 is used to refer to a particular element in one figure, the numeral 10 appearing in any other figure refers to the same element.

Figure 1:
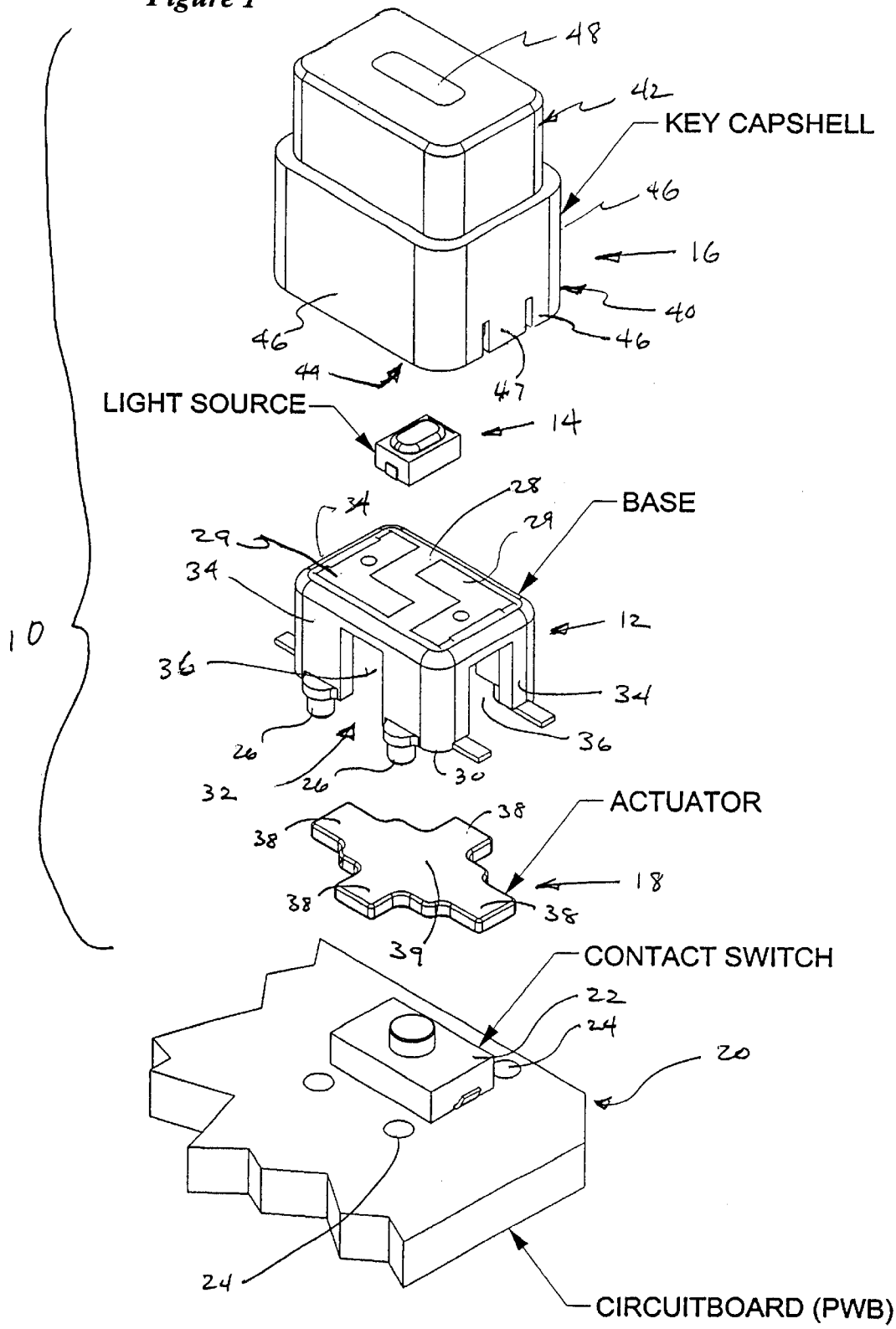
FIG. 1 is an exploded isometric view of an embodiment of the inventive switch assembly.

FIG. 1 illustrates an embodiment of the inventive switch assembly 10. The switch assembly 10 comprises five main components: a contact switch 22; a base 12; an optional light source 14; a cap 16; and an actuator 18. When assembled, all five components are attached, directly or indirectly, to a circuit board 20 having a contact switch 22 attached thereto. Overall size of the switch assembly 10 can range from small (0.437" by 0.287"), up to virtually any size. The size is limited mainly by the electronic components such as the switch and light source, which are getting smaller all the time. The switch assembly 10 can be made as small as necessary to accommodate increasingly minute components.

The circuit board 20 is a commonly available electronic component, except that it is specifically designed to fit the switch assembly 10. The circuit board has special provisions 24 near the switch mounting area, for precise alignment of the base 12 and the switch 22. Similarly, the base 12 has mating features 26 to align with the circuit board, contact switch and cap. Specific overall design of the circuit board varies to fit the desired product configuration.

The contact switch 22 is mounted directly to the circuit board 20 by well-known means such as soldering, similar to any switch assembly using normal surface or through-hole mounting. The contact switch 22 can be selected from a variety of commercially available switches and provides electrical contact as force is applied to the cap 16, the actuator 18 and consequently the contact switch 22. Many types of mechanically actuated contact switches may be integrated into this embodiment, but the contact switch 22 is preferably a "dome switch" such as EDAU (made by ITT) or Snaptron switch, or a small "encapsulated dome" switch like the KSR and KSA devices manufactured by ITT. Examples of alternatives to a mechanically actuated switch include non-contact or optically coupled switches, momentary contact type switches, or switches having continuous contact with alternating open or closed functions.

The base 12 is generally hexahedral in shape, although other shapes and configurations (for example, cylindrical or polyhedral) are possible, depending on the application and type of contact switch used. The base 12 has a closed top 28, an open bottom 30 which leads to an interior cavity 32, and four lateral sides 34. Each lateral side 34 has therein a slot 36 through which project the tabs 38 of the actuator 18 (described below). The bottom 30 of the base is positioned on, and attached to the circuit board 20, such that the contact switch 22 and actuator 18 fit within the interior cavity 32 of the base. The base 12 has mating features 26 to align with the circuit board 20, contact switch 22, and cap 16. The base mounts over the contact switch and provides precise location between the cap 16 and actuator 18 in relation to the contact switch. The base 12 also functions as a guide for the cap during actuation. The intrinsic locating features on each base have provisions for insuring proper stack-up and alignment to the circuit board and related switch, thereby providing a repeatable switch actuation event. Actuation on multiple switch assemblies is more consistent from one to the next. As a result, tactile feedback to the operator is consistent. The base 12 can be made of any available material, but is preferably made of molded plastic.

When used in conjunction with the optional light source 14 to produce an illuminated switch assembly, the base 12 provides mounting, positioning, and power for the light source. The base elevates the light source above the circuit board and related switch (as illustrated), positions it within the cap, and insures an unobstructed path from the light source 14 to the cap 16. The base 12 also has circuitry 29 thereon which connects to the circuit board 20 to transmit electrical power from the circuit board to the light source mounted on the base. The circuitry 29 can simply comprise conductive materials or can also be a small circuit board, both of which provide paths to and from the circuit board for electrical power to reach the light source and a return via commons or grounds. If required, some additional related electronic components such as resistors or diodes can be added to the circuitry 29 on the base. The base may be molded or formed around the conductive material, or the conductive material can be plated onto the base with methods similar to those used in manufacturing circuit boards. This provides a modular component and can add strength as well as resistance to degradation due to vibration. The base can also be configured to accept multiple individual light sources. The quantity, position, type, or color of light sources can be changed to fit the need. Similarly, the circuitry can be wired to permit activation of individual light sources, or multiple/banked light sources.

The optional light source 14 is used when the switch assembly 10 is illuminated; illuminated switch assemblies are typically used as "annunciators" that indicate the switch function is on, or has changed status. Light sources can also be used to simply illuminate the cap for identification purposes and include indicia such as letters, numbers or symbols. When present, the light source 14 is mounted to the top 28 of the base and is powered by the conductive materials or electronic circuits 29 that are integrated into the base and connected to the circuit board, as described above. There may also be more than one light source in a particular switch, for example in a case where the switch controls a function that can have more that two statuses. The detail of the indication can vary widely based upon the selection of indicia, brightness, colors, etc. The particular light source used depends on the design requirements, but can include light emitting diodes (LED), organic light emitting diodes, electro-luminescent lamps, incandescent lamps, LCD or other lighted display technologies.

The actuator 18 is located within, and retained by, the base and/or the cap. The actuator provides a mechanical link between the cap and the contact switch; it is uniquely configured to transmit the force from the cap on the outside of the base, to the contact switch located under the base. The actuator 18 has a cruciform shape with a plurality of tabs 38 projecting from a center portion 39. Each tab 38 extends through one of the slots 36 in the sides 34 of the base, and is secured to the cap 16 via the snap features 47. The actuator is positioned in the interior cavity 32 of the base with its center portion 39 directly over and in mechanical contact with the contact switch 22. The actuator 18 is dimensionally configured to function with the specific switch selected and overall design stacking. In some cases the cap-shell 16 and the actuator 18 may fit snugly or snap together during assembly. The fit allows for ease of assembly/disassembly and permits easy cap-shell changes, even after the base has been mounted to the circuit board.

When pushed by a user, the cap 16 actuates the contact switch 22 via the actuator 18, and also provides a visual and tactile interface for the user. The cap 16 comprises a lower portion 40 and an upper portion 42. The lower portion 40 has the same general shape as the base 12 and has an interior cavity 44 designed to slidably receive the base 12 therein. During operation of the switch, the sides 46 of the lower portion 40 slide relative to the base 12 and their interior sides are in contact with the tabs 38 of the actuator, which project through the sides of the base. This physical relationship of the cap 16 to the base 12 provides a bearing surface and support for the cap that minimizes undesirable cocking when the cap is actuated at the corner or "off-axis." The cap also allows the base 12 to fit internal to the cap 16, which allows for very compact size and permits a wide selection of configurations. Another unexpected benefit is that the embodiment allows a large variation in cap size and shape while maintaining the base size and shape. A minimum of base sizes and shapes will work with all foreseeable cap shapes and sizes.

The upper portion 42 of the cap is attached to the lower portion 40 and in this embodiment has roughly the same shape as the lower portion, although it may be shaped differently than the lower portion, such as by making the upper portion 42 round or polyhedral. The upper portion 42 also has an interior cavity therein which connects with the interior cavity 44 of the lower portion. The upper portion 42 has a lens 48 at the end opposite the lower portion 40. As used herein, the term "lens" is not restricted to its traditional sense (i.e., a member that refracts and focuses light), but rather includes any kind of transparent or translucent material through which light can be transmitted, whether or not it has any refractive properties. The lens 48 may have indicia such as letters, numbers or symbols thereon to indicate, for example, the function operated by the switch. The upper portion 42 includes an internal reflector 50 (FIG. 2) for increasing the light output from the lens 48 to enhance off-axis viewing and readability in direct sunlight. The lens 48 and internal reflector 50 are used in cases where the switch assembly 10 is illuminated. The lens size or illuminated area of the cap 16 can be varied; the entire top of the cap can be a light transmitting area, or the light transmitting area can be made very small.

The cap 16 can be manufactured using almost any known material or manufacturing technology. It can be machined or molded, made of clear or translucent material and painted in all areas except the lens 48. It can be also be painted in all areas and laser or photo etched to add detailed indicia. It can be engraved and filled. The cap can be molded in solid color with a "double shot or insert" mold process that allows a clear lens provision within the solid color. It can also be molded entirely of clear material and painted, permitting the use of the entire top of the cap for indicia. Additionally, it can be thermally formed from the desired materials. A wide variety of cap shapes, configurations, indicia and sizes can be used. Filtration and modification of the light from the source 14 can also be achieved within the cap through known technologies such as filter media, surface textures and patterns, material colors, deposited materials and dyes.

Switch assemblies are typically illuminated through light transmitting material in the assembly. Illuminated switch assemblies require features, which transmit light from the light source behind or within the assembly to the visible section of the assembly. Illuminated switch assemblies typically have features around each assembly, within the housing/panel or board to which the assembly is mounted to insure little or no light leaks from that area. In some versions switch assemblies have a lens area as used for on-the-assembly annunciation and typically indicates that the related assembly function has been activated/turned on. It can also be illuminated with identifying indicia to help the operator find the correct switch in dark conditions. This is typically known as "backlighting" or "area lighting." In other configurations it may not have provisions for lighting and in multiple unit assemblies could provide combinations of illuminated and non-illuminated assembly positions.

Figure 2:
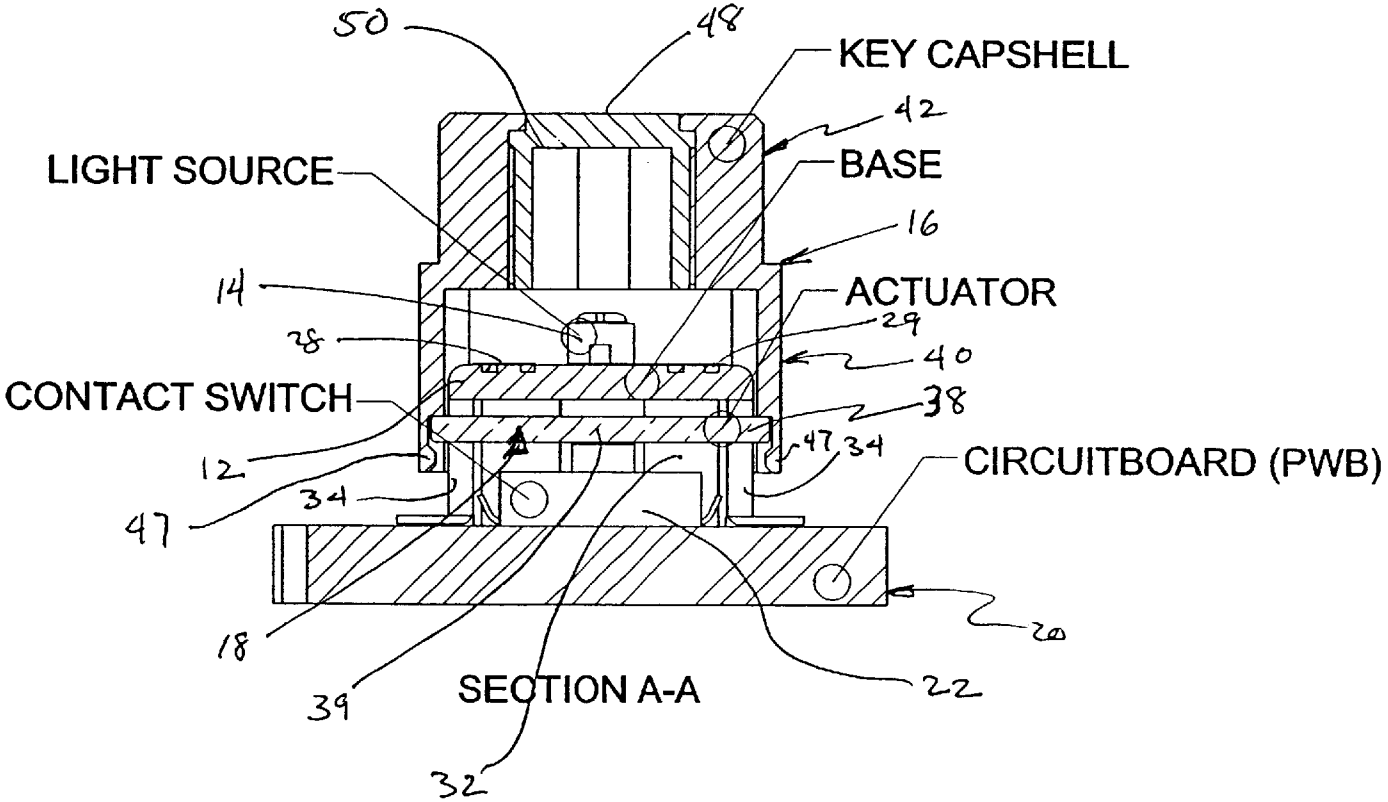
FIG. 2 is a sectional view of the switch assembly of FIG. 1, showing the switch assembly in its assembled condition.

FIG. 2 shows a cross-sectional view of the switch assembly 10 in its assembled state. The base 12 is firmly mounted to the circuit board 20, and the actuator 18 is positioned within the interior cavity 32 of the base. The center portion 39 of the actuator 18 is in contact with the contact switch 22, while the tabs 38 project out the sides 34 of the base and are in contact with the cap 16. The tabs 38 can be secured to the cap 16 if desired using the snap features 47 on the sides 46 of the lower portion 40. The cap 16 is slidably mounted over the base 12 so that the base 12 fits into the interior of the lower portion 40 of the cap. The upper portion 42 of the cap includes an internal reflector 50 to guide the light emitted by the light source 14 to the lens 48 found at the top of the cap. The light source 14 is mounted on the closed end (top) 28 of the base, and is powered by the circuitry 29 built into the base. In operation, a user presses the cap 16 toward the circuit board 20. The cap 16 slides relative to the base 12, so that the force applied by the user is transmitted to the actuator 18. The actuator in turn transmits the force to the contact switch 22, thus turning the switch on or off, as the case may be. The contact switch also controls the status (i.e., on or off) of the light source 14.

The switch assembly 10 is uniquely configured to combine existing technology in a new way. It provides a small, deceptively simple, yet effective device. The unique design allows removal and installation of the cap assembly for rapid panel or keyboard reconfiguration. The cap can be easily removed from the base and actuator, or changed with another shape/size or indicia. A different front panel housing or keyboard face can be placed over the reconfigured switch array, creating a different end product. This allows rapid or last minute assembly reconfigurations. Larger self-contained discrete switches with individual housings are available, however this embodiment provides a configuration that is small and does not require an individual housing for each switch. Moreover, the commercially available discrete switches are longer and they require more depth or penetration into the device behind the front surface.

As a result of the size and unique configuration, the switch assembly 10 can be used individually or in switch arrays and combined in a multitude of ways. The switch assembly is unexpectedly efficient in the final stack-up of components from a space and performance standpoint. Due to the small "footprint" of this embodiment, little room is required on the circuit board for each switch position, more space is available for other functions, circuitry and components. This configuration stacks the components into a very efficient package. Extremely small switch or key and switch assemblies can be made thereby allowing dense population of annunciated (or non-annunciated) human interface devices on a panel or keyboard.

The design provides highly effective illumination or annunciation of a moving key by uniquely placing the stationary light source(s)/display and related circuitry within the body of a key. The key moves during actuation. Because the light source(s)/display are mounted on the base above the circuit board 20 and the switch 22, it can be well positioned and easily aligned with the "lens" or illuminated indicia area in the cap, as compared to existing technology.

The light source(s) (LED, OLED, incandescent, electroluminescent, LCD, and illuminated display) are positioned within a cap that moves during actuation. The design lends itself to configuration for "split cavity" or "split legends" allowing independently illuminated indicia and/or colors of indicia within the same cap.

Because the light source are stationary, the embodiment is more robust as flexible circuitry or moving contact is not required for supplying power to and from the source.

An embodiment of the present switch assembly has been described above. A person skilled in the art, however, will recognize that many other embodiments are possible within the scope of the claimed invention. For this reason, the scope of the invention is not to be determined from the description of the embodiment, but must instead be determined solely from the claims that follow.

What is claimed is:

1. A push-button switch assembly adapted for use on a printed circuit board having a contact switch attached thereto, the switch assembly comprising:

a base attachable to the printed circuit board, the base having an interior cavity sized and shaped to receive the contact switch therein;

an actuator disposed within the interior cavity of the base and positioned in contact with the contact switch; and a cap having an interior cavity therein, wherein a portion of the interior cavity of the cap is sized to slidably receive the base therein, and wherein the cap is in contact with the actuator.

2. The push-button switch of claim 1 wherein the base has a slot in at least one side thereof.

3. The push-button switch of claim 2 wherein the actuator has at least one tab which projects through the slot so that it can be contacted by the cap.

4. The push-button switch of claim 1 wherein the base has electric circuitry embedded therein, the electric circuitry being connectable to the printed circuit board.

5. The push-button switch of claim 4 further comprising a light source attached to a top of the base.

6. The push-button switch of claim 1 wherein the cap has an open end and a closed end, and wherein the closed end has a lens thereon.

7. The push-button switch of claim 6 wherein the cap has an internal reflector therein designed for transmission of light to the lens.

8. A push-button switch assembly adapted for use on a printed circuit board having a contact switch attached thereto, the switch assembly comprising:

a base attachable to the printed circuit board, the base having an interior cavity designed to receive the contact switch therein and having a slot in a side thereof;

an actuator disposed within the interior cavity of the base and positioned to bear against the contact switch, wherein the actuator includes a tab which projects through the slot in the base; and a cap having therein an interior cavity, wherein a portion of the interior cavity of the cap is sized to slidably receive the base therein, and wherein the cap is in contact with the actuator.

9. The push-button switch of claim 8 wherein the base is cylindrical or polyhedral.

10. The push-button switch of claim 8 wherein the base is hexahedral and has a closed top end, an open bottom end, and a plurality of sides extending between the top end and bottom end, wherein each side has a slot therein.

11. The push-button switch of claim 10 wherein the actuator is cruciform-shaped and has a plurality of tabs which project through the slot so that the tabs can be contacted by the cap.

12. The push-button switch of claim 8 wherein the cap has an open end and a closed end and has an area for indicia on the closed end.

13. The push-button switch of claim 8 wherein the base has electric circuitry embedded therein or plated thereon, the electric circuitry being connectable to the printed circuit board.

14. The push-button switch of claim 13 further comprising a light source attached to a top of the base.

15. The push-button switch of claim 14 wherein the cap has an open end and a closed end, and has a lens on the closed end.

16. The push-button switch of claim 15 wherein the cap has an internal reflector therein designed for transmission of light to the lens.

* * * * *